United States Patent [19]

Hirshfeld

[11] Patent Number: 4,515,373

[45] Date of Patent: May 7, 1985

[54] HAND-HELD BALL GAME

[75] Inventor: Uri Hirshfeld, Kibbutz Malkia, Israel

[73] Assignee: Orda Industries Ltd., Kibbutz Malkia, Israel

[21] Appl. No.: 572,909

[22] Filed: Jan. 23, 1984

[30] Foreign Application Priority Data

Feb. 1, 1983 [IL] Israel ..... 67807

[51] Int. Cl.[3] ..... A63F 7/00

[52] U.S. Cl. ..... 273/317; 273/109

[58] Field of Search ..... 273/317, 322, 323, 328, 273/329, 330, 340, 109, 110

[56] References Cited

U.S. PATENT DOCUMENTS 2,242,450 5/1941 Carballal ..... 273/322

4,385,766 5/1983 Grow ..... 273/328

*Primary Examiner*—William H. Grieb

*Attorney, Agent, or Firm*—Benjamin J. Barish

[57] ABSTRACT

A hand-held ball game comprises a transparent enclosure of spherical configuration containing a ball within it and having an opening through its upper end of a slightly larger diameter than the ball to permit ejection of the ball through the opening by a quick manipulation of the enclosure while held in an upright position.

17 Claims, 2 Drawing Figures

HAND-HELD BALL GAME

BACKGROUND OF THE INVENTION

The present invention relates to a hand-held ball game, an object of the invention being to provide such a game which not only offers amusement in playing the game, but also tests the dexterity and the agility of the player.

SUMMARY OF THE INVENTION

According to a broad aspect of the present invention, there is provided a hand-held ball game comprising: an enclosure, at least the upper end of which is transparent to permit viewing its interior; a ball within the enclosure; and an opening through the upper end of the enclosure of a slightly larger diameter than the ball to permit ejection of the ball therethrough by a quick manipulation of the enclosure while held in an upright position.

In the preferred embodiment of the invention described below, the enclosure includes a channel of substantially semi-cylindrical configuration constraining the movement of the ball to a line intersected by the longitudinal axis of the opening through the upper end of the enclosure. The channel is downwardly inclined from its outer end to its inner end, and is raised from the bottom of the enclosure.

In addition, the opening through the upper end of the enclosure is defined by a hollow sleeve extending into the interior of the enclosure. The sleeve is telescopically received in a cylindrical collar fixed to the enclosure to permit varying the degree of extension of the sleeve into the enclosure. The inner end of the sleeve is cut at a bias.

The latter features enable varying the difficulty for ejecting the ball from the enclosure by the quick manipulation required to be performed by the player.

Further features and advantages of the invention will be apparent from the description below.

BRIEF DESCRIPTION OF THE DRAWINGS

The invention as herein described, by way of example only, with reference to the accompanying drawings, wherein.

DESCRIPTION OF A PREFERRED EMBODIMENT

Figure 1:
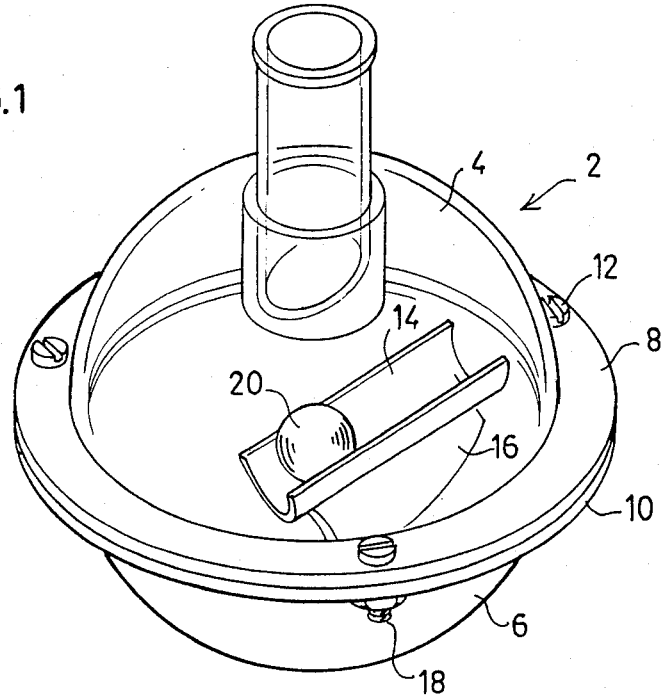
FIG. 1 is a three-dimensional view illustrating one form of hand-held ball game constructed in accordance with the present invention.

The game illustrated in the drawings comprises a spherical enclosure or housing, generally designated 2, constituted of two semi-spherical sections 4 and 6. Each of the two sections is formed with an annular flange 8 and 10, respectively, at their open ends, which flanges receive fastener elements 12 to secure the two sections together.

At least the upper section 4, but preferably both sections 4 and 6, are formed of transparent material so as to permit viewing the interior of the enclosure.

Within the enclosure 2 there is provided a channel or trough 14 raised above the bottom of the enclosure by a vertical plate 16 secured to the bottom section 6 by means of a fastener 18. Channel 14 is supported at a downward incline from its outer end to its inner end, as shown particularly in FIG. 2.

Also disposed within enclosure 2 is a ball 20 of a diameter so as to be receivable and rollable within channel 14.

Figure 2:
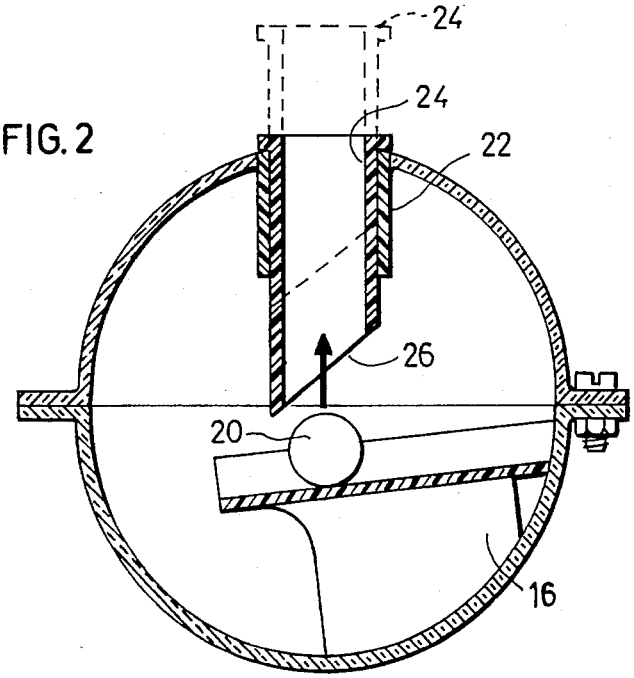
FIG. 2 is a longitudinal sectional view through FIG. 1.

The upper section 4 of the enclosure is formed with an opening circumscribed by a cylindrical collar 22 fixed to this upper section. Collar 22 telescopingly receives a sleeve 24, which sleeve is movable within the collar to permit varying the degree of penetration or extension of the sleeve within the enclosure. Thus, as shown in FIG. 2, sleeve 24 overlies one end of the channel 14 and the extension of the sleeve into the enclosure may be varied from an innermost position (shown in full lines) spaced slightly above the ball 20 when disposed in channel 14, to an outermost position (shown in broken lines) wherein the inner end of the sleeve is spaced substantially above the channel. The inner end of sleeve 24 is cut at a bias, as shown at 26.

It will be seen that channel 14, along which ball 20 may roll, extends from an edge of the sphere in a radial direction to a point slightly past the center of the sphere. It will also be seen that channel 14 underlies sleeve 24 and intersects an extension of its longitudinal axis. The channel is of substantially semi-cylindrical configuration and thus constrains the ball 20, when moving thereon, to move along a line intersecting the longitudinal axis of the sleeve 24.

The game is played in the following manner. First, sleeve 24 is adjusted to a predetermined position to fix the difficulty of the game. Thus, playing the game is easiest when sleeve 24 is in the innermost position as illustrated in full lines in FIG. 2, the difficulty being increased the more the sleeve is moved outwardly towards its outermost position shown in broken lines in FIG. 2.

In playing the game, the player grasps the annular flanges 8, 10 between the fingers of his two hands, manipulates the device to bring the ball 20 into the channel 14, and then inclines the device so as to cause the ball to roll by gravity along the channel until it is in alignment with the sleeve 24. At this instant, the player quickly manipulates the enclosure downwardly, so as to try to eject the ball 20 through the sleeve 24 and out through the housing.

Since the inclined channel 14 constrains the ball to move along the channel, the ball can be ejected from the enclosure only if the enclosure is quickly manipulated downwardly when the ball exactly underlies the sleeve 24, thereby testing the dexterity and agility of the player. As indicated earlier, the ejection of the ball can be made more difficult by moving sleeve 24 to its outermost position, shown in broken lines in FIG. 2, wherein its lower biased edge 26 is more distantly spaced from the channel 14. It can also be made more difficult by rotating the sleeve so that its biassed edge 26 faces away from the ball while moving in the channel 14.

While the invention has been described with respect to one preferred embodiment, it will be appreciated that many other variations, modifications and applications of the invention may be made.

What is claimed is:

1. A hand-held ball game, comprising: an enclosure, at least the upper end of which is transparent to permit viewing its interior; a ball within said enclosure; an opening through the upper end of said enclosure of a slightly larger diameter than said ball to permit ejection of the ball therethrough by a quick manipulation of the enclosure while held in an upright position; and a channel of substantially semi-cylindrical configuration disposed within said enclosure and constraining the movement of the ball to a line intersected by the longitudinal axis of said opening through the upper end of the enclosure.

2. The game according to claim 1, wherein said channel is downwardly inclined from its outer end to its inner end.

3. The game according to claim 1,
wherein said channel is raised from the bottom of said enclosure.

4. The game according to claim 1,
wherein said enclosure is substantially of spherical configuration.

5. The game, according to claim 1,
wherein said opening through the upper end of said enclosure is defined by a hollow sleeve extending into the interior of the enclosure.

6. The game according to claim 5, wherein said sleeve is telescopingly received in a cylindrical collar fixed to said enclosure to permit varying the degree of extension of the sleeve into said enclosure.

7. The game according to claim 5,
wherein the inner end of said sleeve is cut at a bias.

8. The game according to claim 1,
wherein said enclosure is made of two transparent semi-spherical sections joined together along their open ends.

9. The game according to claim 8, wherein said two semi-spherical sections are joined together along annular flanged formed at their open ends, which annular flanges also serve as finger-gripping elements for the player while playing the game.

10. A hand-held ball game, comprising: an enclosure of substantially spherical configuration, at least the upper end of which is transparent to permit viewing its interior; a ball within said enclosure; and an opening through the upper end of said enclosure of a slightly larger diameter than said ball to permit ejection of the ball therethrough by a quick manipulation of the enclosure while held in an upright position.

11. The game according to claim 10, wherein said enclosure includes a channel of substantially semi-cylindrical configuration constraining the movement of the ball to a line intersected by the longitudinal axis of said opening through the upper end of the enclosure.

12. The game according to claim 11, wherein said channel is raised from the bottom of the enclosure and is downwardly inclined from its outer end to its inner end.

13. The game according to claim 11, wherein said opening through the upper end of said enclosure is defined by a hollow sleeve extending into the interior of the enclosure.

14. A hand-held game, comprising: an enclosure, at least the upper end of which is transparent to permit viewing its interior; a ball within said enclosure, and a hollow sleeve disposed at the upper end of said enclosure and extending into the interior thereof; said hollow sleeve defining an opening through the upper end of said enclosure of a slightly larger diameter than said ball to permit ejection of the ball therethrough by a quick manipulation of the enclosure while held in an upright position.

15. The game according to claim 14, wherein said enclosure includes a channel of substantially semi-cylindrical configuration constraining the movement of the ball to a line intersected by the longitudinal axis of said opening through the upper end of the enclosure.

16. The game according to claim 14, wherein said channel is raised from the bottom of said enclosure and is downwardly inclined from its outer end to its inner end.

17. The game according to claim 14, wherein said sleeve is telescopingly received in a cylindrical collar fixed to said enclosure to permit varying the degree of extension of the sleeve into said enclosure.

* * * * *